US005163869A

United States Patent [19]

Yeh et al.

[11] Patent Number: 5,163,869

[45] Date of Patent: Nov. 17, 1992

[54] METHOD AND APPARATUS FOR VENTILATING GASES CONTAINING CONDENSABLE VAPORS

[75] Inventors: George C. Yeh, 2 Smedley Dr., Newtown Square, Pa. 19073; Maximillian S. Yeh, Newtown Square, Pa.

[73] Assignee: George C. Yeh, Newtown Square, Pa.

[21] Appl. No.: 803,190

[22] Filed: Dec. 5, 1991

[51] Int. Cl.[5] ..... F24C 15/20

[52] U.S. Cl. ..... 454/67; 126/299 D

[58] Field of Search ..... 454/49, 67; 126/299 R, 126/299 D, 299 F; 432/72

[56] References Cited

U.S. PATENT DOCUMENTS

| | | | |
|---|---|---|---|
| 2,494,146 | 1/1950 | Spanos . | |
| 2,886,124 | 5/1959 | Scharmer . | |
| 2,889,007 | 6/1959 | Lunde . | |
| 2,933,080 | 4/1960 | Adey | 126/299 F |
| 3,785,778 | 1/1974 | Burstein et al. . | |
| 3,827,343 | 8/1974 | Darm . | |
| 3,911,895 | 10/1975 | Van Schoyck . | |
| 4,235,220 | 11/1980 | Hepner | 126/299 D |
| 4,987,882 | 1/1991 | Kaufman . | |

*Primary Examiner*—Robert G. Nilson

*Attorney, Agent, or Firm*—Howson and Howson

[57] ABSTRACT

A method and apparatus for exhausting a mixture of air laden with droplets and vapors of greases and oils from a room such as a kitchen. A motor-driven fan is mounted within a duct to exhaust the mixture to outside the room. A heater located near the intake of the duct vaporizes any droplets of grease and oil in the air, and then superheats the resulting mixture to a temperature below the ignition point. The exhaust fan motor also drives a separate fan for cooling the motor with air drawn from the outside. The superheat temperature is regulated by the exhaust fan speed and current input to the heater.

12 Claims, 3 Drawing Sheets

Fig. 1
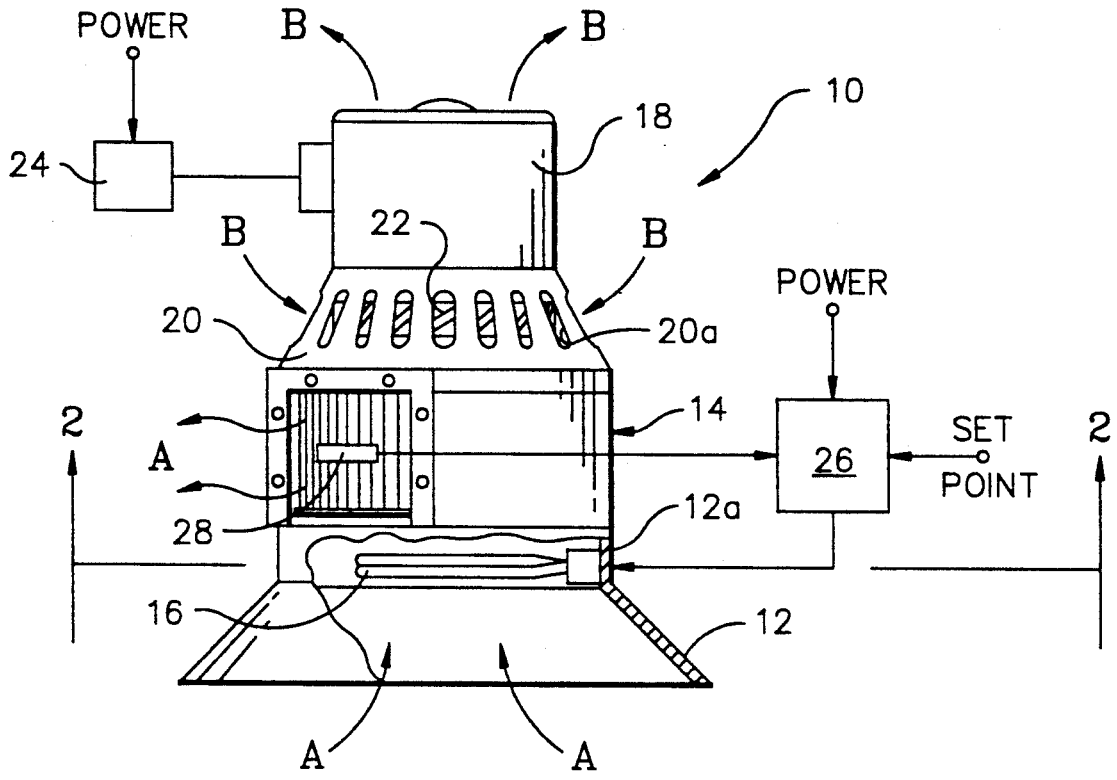
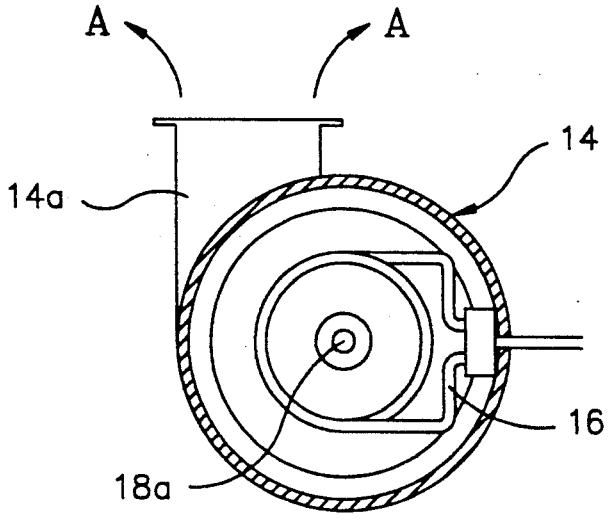
Fig. 2

METHOD AND APPARATUS FOR VENTILATING GASES CONTAINING CONDENSABLE VAPORS

BACKGROUND OF THE INVENTION

1. Field of the Invention

This invention relates generally to ventilating gases containing condensable vapors from enclosed spaces; and more particularly to a method and apparatus for exhausting mixtures of gases, entrained particulates and vapors, such as air ladened with particulate and vapors of oils, greases, fat, solvents, and smoke.

2. Description of the Prior Art

Domestic and commercial kitchens, machine shops, factories and similar work spaces with ovens, roasters, ranges, painting and welding booths, industrial furnaces and the like, usually have ventilating systems installed to prevent the buildup in the air of smoke, fumes and vapors to which exposure may be injurious to health as well as become a fire hazard. The contaminant mixture is typically exhausted from the space through a duct to the outdoors by a motor-driven fan, but the carbonaceous particles and flammable droplets of grease, oil and solvents tend to rapidly accumulate in various parts of the ventilation system including the hood, ducts, and exhaust fan and on adjacent building surfaces. Filters and traps are commonly used to capture these contaminants but do not completely solve the problem.

One exhaust system frequently installed in kitchens is equipped with replaceable filters such as disclosed in U.S. Pat. No. 2,886,124 to G. A. Scharmer. Other systems as described in U.S. Pat. Nos. 2,889,007 to K. E. Lunde and 2,494,146 to P. A. Spanos employ a trap in which grease particles are removed by gravity. Still another system disclosed in U.S. Pat. No. 3,911,895 to Q. H. Van Schoyck collects and isolates the grease and other contaminants in a mesh liner removably attached to the interior of a hood and exhaust duct. In each of these systems, the exposed components must be cleaned or replaced periodically to prevent clogging and to minimize resistance to the air flow.

U. S. Pat. No. 4,987,882 to A. S. Kaufman discloses still another system in which a roof-mounted exhaust fan diverts the grease-laden air past a scoop. The grease adheres to the surface of the scoop and drains into a collector below the scoop where it can be separated by a flotation trap from any rain water which may accumulate.

U.S. Pat. No. 3,827,343 to W. J. Darm utilizes a heat exchanger for condensing the grease and oil vapors with cooling air drawn from outside the building. The temperature of the cooling air is raised reclaiming sufficient heat for returning to the building. As in the other systems, the heat exchanger and ducts must be periodically cleaned of accumulated grease condensate.

The ventilation system described in U.S. Pat. No. 3,785,778 to Bernstein et al. removes the grease and oils from the exhausted air by combustion. An electrically-heated, catalyst-coated refractory block is located between the intake and the exhaust fan. Combustible vapors drawn through the block are heated to their ignition temperature, and the products of the combustion are then exhausted. Such a system, of course, should be very carefully regulated to prevent fire.

From all of the above, it is apparent that such systems offer only partial solutions to the problems that they attempt to solve. Either they do not completely prevent the accumulation of fire-hazardous pollutants, or extreme cautionary measures must be taken to maintain safe operation. However, if these pollutants were first exhausted outside of the building using air as the carrier, many well-known fluid-separating techniques, such as absorption, adsorption, extraction, precipitation, filtration and combustion can be used.

SUMMARY OF THE INVENTION

It is therefore an object of the present invention to provide a novel and improved ventilation system which prevents hazardous and injurious vapors and particulate matter of grease, oil, fat, solvent and the like contained in a gas from accumulating in the system.

Another object of the invention is to provide a system which exhausts air containing injurious and hazardous vapors and particulate matter from a building, which requires minimum maintenance and service, and which can be readily installed inside or outside the building.

Still another object is to provide a method for ventilating an enclosed space of combustible particulate and vapors contained in a gas.

Briefly, these and other objects are achieved with a ventilation system having a motor-driven exhaust fan mounted within a duct to conduct vapor-laden gases from an enclosed space to the outside. A heater located near the intake of the duct vaporizes any liquid droplets entrained in the gas, and then superheats the gas-vapor mixture to a temperature below its ignition point. The same motor which drives the exhaust fan also drives a cooling fan which cools the motor with gas from a separate external source. The superheat temperature is regulated by the exhaust fan speed and current input to the heater.

BRIEF DESCRIPTION OF THE DRAWINGS

For a better understanding of these and other objects and aspects of the invention, reference will be made to the following detail description taken in conjunction with the accompanying drawings wherein:

FIG. 1 is a schematic side elevation view of one embodiment of a ventilation system according to the invention suitable for installation above a kitchen cooking range;

FIG. 2 is a bottom view of the ventilation system of FIG. 1 taken along the line 2—2;

DESCRIPTION OF THE PREFERRED EMBODIMENTS

Figure 3:
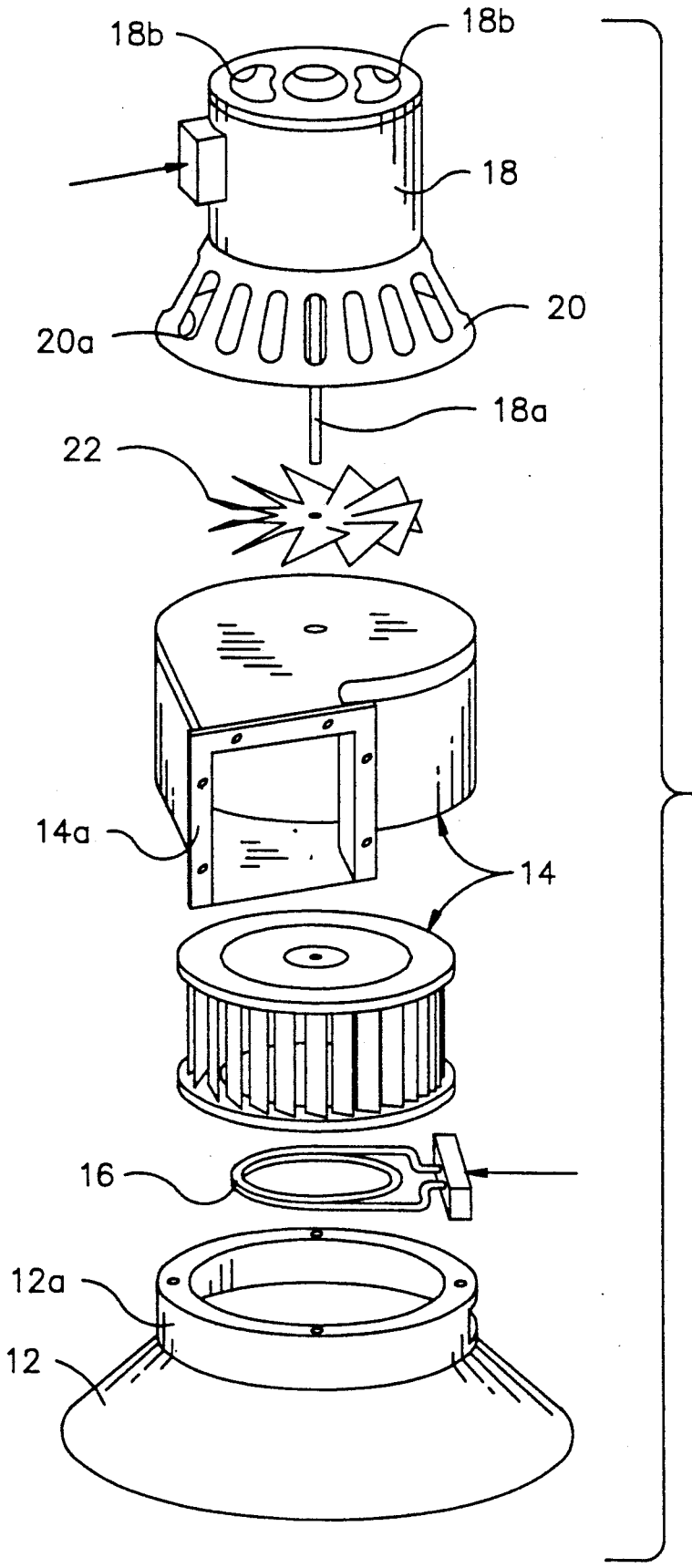
FIG. 3 is an exploded view of components of the ventilation system of FIG. 1.

Superheating a mixture of combustible vapor and air to a temperature in a range above its dew point but below its ignition point prevents both condensation and ignition of the mixture. The superheated state may be produced in several ways including lowering the vapor-to-air concentration at a given vapor temperature, or by raising the temperature of the mixture at a given concentration. The vapor-to-air concentration can be lowered by diluting the vapor with more air.

The ignition temperature of the mixture is determined by the flash point and the vapor-to-air concentration of the mixture. Therefore, the mixture can be made virtually non-flammable and cannot be ignited at any temperature if the concentration is made very low. In general, the more volatile the combustible vapor, the lower the dew point of the mixture; and the more combustible the vapor, the more flammable the mixture at a given vapor concentration and total pressure. Accordingly, the ignition temperature of a combustible air-vapor mixture is lower. Conversely, the higher the concentration of the vapor at a given total pressure, the lower the ignition point.

The amount of heat needed to vaporize all the combustible liquid particulate in air and superheat the mixture to a desired temperature is determined by the quantity of all combustibles to be vaporized, the specific heat of the vapor-laden air, the air flow rate, and the inlet temperature of the air at a given pressure. Where the mixture must be transported through a long duct, it will experience a heat loss which can be readily compensated by heating the mixture a few degrees higher than that needed for superheating the mixture.

Thus, a small droplet or particle of pure combustible matter per se will ignite if heated to its ignition temperature. But if it is mixed with a very large quantity of air, whereby the mole ratio of combustible matter-to-air is far below the flammable ratio, it is not possible to ignite the mixture. This is because the excess air acts like an inert gas consuming heat without reacting chemically to release enough heat to sustain combustion.

Referring now to the drawings where like reference characters designate like or corresponding parts throughout the several views, there is shown in FIG. 1 a ventilation system, indicated generally by the numeral 10, which implements these principles by exhausting a mixture A of air containing combustible particulate and condensable vapors from an enclosed kitchen space in which smoke and grease-laden vapors emanate from a cooking range, not shown. The system includes an inverted funnel-like hood 12 proximally located over the range to gather the mixture of air, smoke, and droplets and vapors of grease and oil.

A centrifugal exhaust fan 14, mounted with its inlet communicating with hood 12, draws mixture A into intimate contact with an electric heater 16 disposed in a neck portion 12*a* of the hood. An exhaust fan outlet 14*a* communicates with the outside air through a duct, not shown. Fan 14 is driven by an adjustable speed electric motor 18 coaxially connected by a motor shaft 18*a*. The housing of motor 18 is separated from exhaust fan 14 by a shroud 20 having air intake openings 20*a*. An axial cooling fan 22 within shroud 20 rotates with shaft 18*a* to draw outside air B through openings 20*a* and exhaust it through vents 18*b* at the opposite end of the motor housing for cooling the motor.

Motor 18 is equipped with a manually adjustable speed regulator 24 for regulating the air flow through the system. A thermostatically controlled regulator 26 regulates the heat output of heater 16. A sensor 28, such as a thermocouple or thermistor, located in the exhaust fan outlet 14*a* produces a temperature signal which is compared to a manually adjusted set point for controlling the electrical current to heater 16. The set point must be above the dew point but below the ignition point of mixture A. Normally, regulator 26 energizes heater 16 only when vapor-laden air flows through the system. For given characteristic mixture A, the capacity of both the exhaust fan 14 and heater 16 are predetermined, and the exhaust fan speed and heater current are regulated to maintain the desired conditions for vaporizing and superheating the mixture.

The principle of operation and practicality of the invention will become evident from data taken for a typical combustible and vapor air mixture having the following characteristics:

Atmospheric pressure = 1.0 atm
Partial pressure of combustibles = 0.02 atm
Mole ratio of combustibles to air = 1:50
Estimated dew point $\leqq$ 5.0° C.
Flash point of combustibles $\geqq$ 180° C.
Ignition point = not ignitable up to 1400° C.
Inlet temperature = 30° C.
Density = 1.26 kg/m$^3$
Specific heat = 7.0 kcal/kmol° C.

The inlet temperatures of the mixture was maintained at 30° C. The heat required to maintain a constant outlet temperature of 50° C. for different mixture flow rates is as follows:

| Flow Rate (m3/min) | Heater Work Load (watts) |
|---|---|
| 8.5 | 885.2 |
| 10.0 | 1041.6 |
| 20.0 | 2083.2 |
| 30.0 | 3124.8 |
| 40.0 | 4166.4 |
| 50.0 | 5208.0 |

Figure 4:
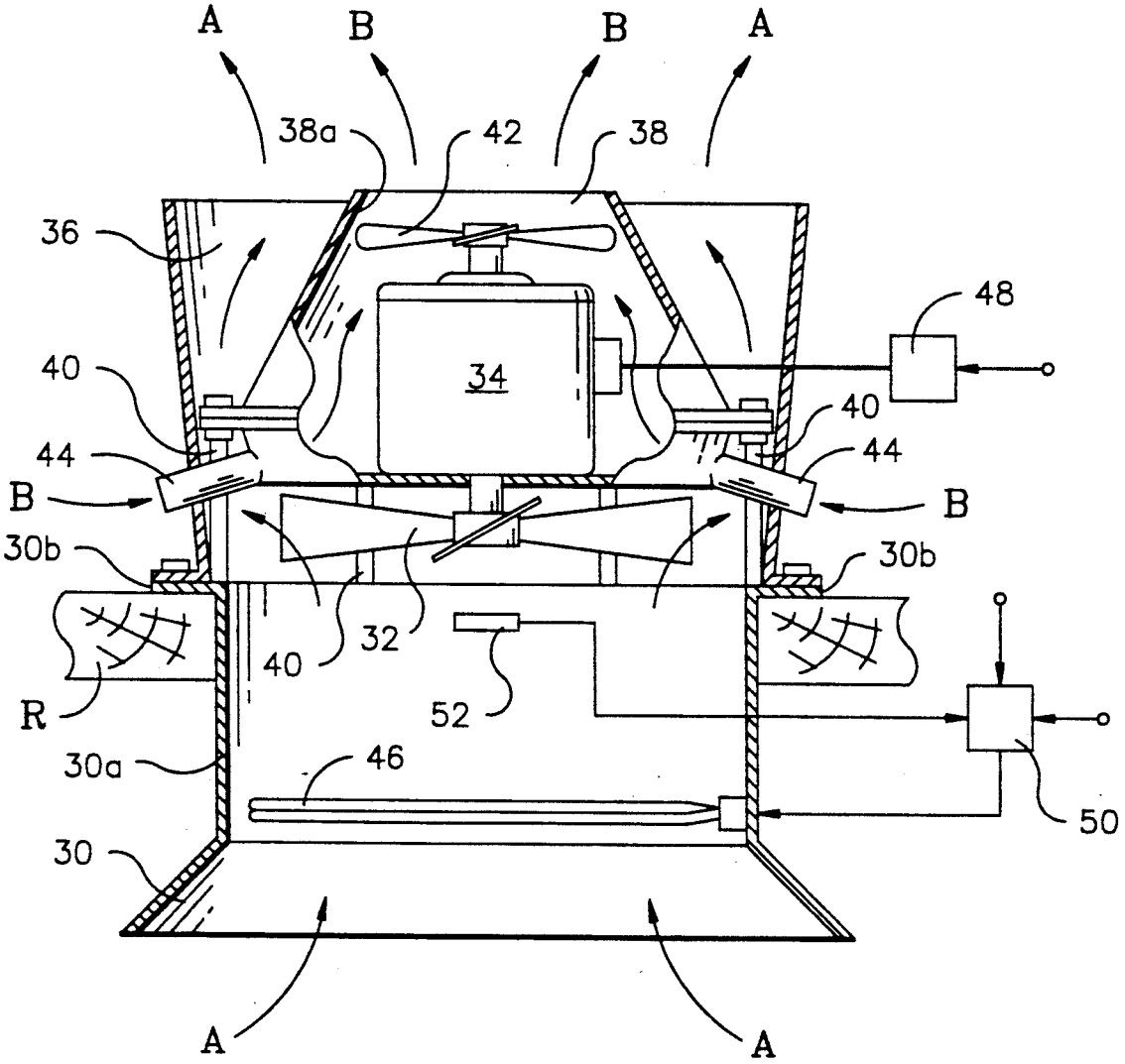
FIG. 4 is a schematic side view in cross section of another embodiment of a ventilation system according to the invention suitable for mounting in the roof of a building.

Referring now to the embodiment illustrated in FIG. 4, the ventilation system is designed for mounting in the roof or wall of a building. A hood 30 includes a neck portion 30*a* extending through an opening in roof structure R and secured by flange 30*b* for establishing communication between the interior of the building and the outside. Vapor and air mixture A is drawn into the intake of hood 30 by an exhaust fan 32 disposed within an exterior duct 36 fixed to and extending from the outlet of hood 30. Fan 32 is driven by an electric motor 34 which is confined within a circular enclosure 38 concentrically supported by brackets 40 fixed to the perimeter of neck portion 30*a* forming thereby an annular passageway for the exhaust gases. Motor 34 also drives a cooling fan 42 which draws air B through inlet tubes 44 radially extending from enclosure 38 through the duct 36 to the outside. An opening 38*a* at the top of enclosure 38 provides an outlet for the motor cooling air.

As exhaust fan 32 draws air into hood 30, a heater 46 raises the temperature of the vapor-laden air. In the same manner as described in the embodiment of FIG. 1, the flow rate is controlled by a motor speed regulator 48. The mixture temperature through the system is thermostatically controlled by heater 46 and a current regulator 50 in response to the temperature of the air-vapor mixture A at a thermometer 52 located in neck portion 30*a*. As noted previously, heater 46 normally operates only when motor 34 is energized and vapor-laden air is flowing through the system.

It should be apparent that the system as described is not limited to kitchen installations. Since there is little restriction in size when installed outside at building, the embodiment of FIG. 4 is particularly suitable for commercial and industrial applications.

It should also be apparent that there are several important aspects necessary for successful practice of the invention. In particular, the amount of air drawn in by the exhaust fan must be sufficient to produce a combustible-to-air ratio which is not flammable at the temperature of operation, and the amount of heat added is sufficient to vaporize all the combustibles and superheat the vapors to a temperature where no condensation can take place in the system. At the same time, sufficient cooling must be provided to the exhaust fan motor to prevent it from over-heating.

It will be understood that various changes in the details, steps and arrangement of parts, which have been herein described and illustrated in order to explain the nature of the invention, may be made by those skilled in the art within the principal and scope of the invention as expressed in the above claims.

I claim:

1. Apparatus for ventilating from an enclosed space a mixture of droplets and vapors entrained in a gas, comprising in combination:

a duct for communicating between the space and outside;

a first fan supported in said duct for exhausting the mixture to the outside;

a motor drivingly connected to said first fan; and heater means positioned within said duct upstream of said first fan for superheating the mixture to a temperature below the ignition point thereof.

2. Apparatus according to claim 1 further comprising:

a housing fixed to said duct for partitioning said motor from contact with said mixture.

3. Apparatus according to claim 2 further comprising:

a second fan within said housing drivingly connected to said motor for circulating outside air to said motor.

4. Apparatus according to claim 3 wherein:

said housing includes openings for passing the outside air; and said motor includes inlet and outlet vents communicating with said housing for circulating the outside air therethrough.

5. Apparatus according to claim 3 wherein:

said housing is spatially positioned within said duct for allowing the mixture to pass between said housing and said duct, and includes inlet and outlet vents for circulating the outside air around said motor.

6. Apparatus according to claim 1 wherein said heater means includes:

an electric heating element;

sensor means downstream of said element for producing a signal indicative of the mixture temperature; and regulator means responsive to said signal for controlling electrical current to said element.

7. Apparatus according to claim 1 further comprising:

regulator means operatively connected to said motor means for varying the speed thereof.

8. A system for ventilating a mixture of air containing combustible droplets and condensable vapors, said system comprising:

a ventilation hood formed to be positioned near the source of the vapors and connected to a first passage;

a heater located in the stream of said mixture entering said hood for adding sufficient heat to superheat the vapor-laden air;

an exhaust fan located downstream of said heater to move said mixture through said first passage means;

a motor connected to said exhaust fan for driving said exhaust fan, said motor being located outside said first passage to prevent contact with the mixture;

a cooling fan connected to and driven by said motor for cooling said motor using air extracted through a second passage means, said second passage separate from said first passage means;

an outlet connected to said first passage for exhausting through said first passage the mixture flowing through said heater and said exhaust fan;

an inlet connected to said second passage means for extracting cooling air into said second passage means; and an outlet connected to said cooling fan for exhausting said cooling air.

9. A system according to claim 8 further comprising:

means connected to said heater for regulating the quantity of heat inputted to said mixture.

10. A system according to claim 8 further comprising:

means connected to said motor for regulating the flow rate of the mixture by said exhaust fan.

11. A method for ventilating a mixture of gases and combustible droplets and vapors from an enclosed space, comprising the steps of:

imparting flow to the mixture through a duct with a motor-driven fan;

heating said mixture to vaporize the droplets and to superheat the resulting air-vapors mixture to a temperature above the dewpoint but below the ignition point of the air-vapors mixture.

12. A method according to claim 8 further comprising the step of:

imparting a separate flow of cooling air to the motor of the fan.

* * * * *